US010230187B2

(12) United States Patent
Hasegawa

(10) Patent No.: US 10,230,187 B2
(45) Date of Patent: Mar. 12, 2019

(54) ELECTRICAL CONNECTOR FOR CIRCUIT BOARDS AND MANUFACTURING METHOD THEREOF

(71) Applicant: Hirose Electric Co., Ltd., Shinagawa-ku, Tokyo (JP)

(72) Inventor: Yohei Hasegawa, Tokyo (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 15/800,404

(22) Filed: Nov. 1, 2017

(65) Prior Publication Data

US 2018/0138618 A1 May 17, 2018

(30) Foreign Application Priority Data

Nov. 11, 2016 (JP) ..... 2016-220723

(51) Int. Cl.

| | |
|---|---|
| ***H01R 12/91*** | (2011.01) |
| ***H01R 13/502*** | (2006.01) |
| ***H01R 43/18*** | (2006.01) |
| ***H01R 13/405*** | (2006.01) |
| ***H01R 43/24*** | (2006.01) |
| *H01R 12/71* | (2011.01) |

(52) U.S. Cl.

CPC ..... *H01R 12/91* (2013.01); *H01R 13/405* (2013.01); *H01R 13/5025* (2013.01); *H01R 43/18* (2013.01); *H01R 43/24* (2013.01); *H01R 12/716* (2013.01)

(58) Field of Classification Search

CPC ..... H01R 12/91; H01R 13/6315
USPC ..... 439/246
See application file for complete search history.

(56) References Cited

U.S. PATENT DOCUMENTS 5,201,663 A * 4/1993 Kikuchi ..... H01R 13/6315 439/248
5,873,742 A * 2/1999 McHugh ..... H01R 12/716 439/247
6,155,858 A * 12/2000 Ozawa ..... H01R 13/14 439/248

(Continued)

FOREIGN PATENT DOCUMENTS

JP 3976454 B2 9/2007

*Primary Examiner* — Ross N Gushi
(74) *Attorney, Agent, or Firm* — Procopio, Cory, Hargreaves & Savitch LLP

(57) ABSTRACT

A connector with stationary housings, a movable housing, and terminals. The terminals have a movable-side retained portion including a contact portion secured in place by unitary molding in a movable-side retaining portion of the movable housing, a stationary-side retained portion secured in place by unitary molding at a location proximate the connecting portion of the terminals in a stationary-side retaining portion of the stationary housing, and a resiliently displaceable resilient portion coupling the movable-side retained portion to the stationary-side retained portion. The resilient portion has a curved apex portion constituting the upper end of the resilient portion outwardly of the movable-side retained portion in the connector-width direction, and lateral open spaces, which are open in the connector-width direction, are formed in a range including at least the apex portion below the above-mentioned movable-side retaining portion positioned above the apex portion.

4 Claims, 3 Drawing Sheets

(56) References Cited

U.S. PATENT DOCUMENTS 7,125,260 B2 * 10/2006 Orita ..... H01R 12/57 439/74
7,354,279 B2 * 4/2008 Uesaka ..... H01R 12/57 439/660
7,374,432 B2 * 5/2008 Koguchi ..... H01R 12/725 439/247
7,635,274 B2 * 12/2009 Fukazawa ..... H01R 12/716 439/247
7,637,762 B2 * 12/2009 Uesaka ..... H01R 12/57 439/247
7,862,345 B2 * 1/2011 Fukazawa ..... H01R 12/716 439/74
7,887,350 B2 * 2/2011 Fukazawa ..... H01R 12/707 439/247
8,257,095 B2 * 9/2012 Akai ..... H01R 12/716 439/248
9,033,722 B2 * 5/2015 Kobayashi ..... H01R 12/712 439/248
9,033,743 B2 * 5/2015 Kobayashi ..... H01R 13/11 439/637
9,048,601 B2 * 6/2015 Kimura ..... H01R 24/60
9,160,122 B2 * 10/2015 Sato ..... H01R 12/91
9,178,326 B2 * 11/2015 Funayama ..... H01R 12/91
9,281,594 B2 * 3/2016 Funayama ..... H01R 12/91
9,287,654 B2 * 3/2016 Takaki ..... H01R 13/52
9,698,508 B2 * 7/2017 Kobayashi ..... H01R 13/187
9,799,971 B2 * 10/2017 Ninomiya ..... H01R 12/52
9,887,484 B1 * 2/2018 Hu ..... H01R 13/502
9,941,614 B2 * 4/2018 Sato ..... H01R 12/716
2006/0089018 A1 * 4/2006 Orita ..... H01R 12/57 439/74
2006/0276061 A1 * 12/2006 Koguchi ..... H01R 12/725 439/74
2007/0202729 A1 * 8/2007 Uesaka ..... H01R 12/57 439/248
2008/0296133 A1 * 12/2008 Ura ..... H01R 13/6315 200/1 A
2009/0239421 A1 * 9/2009 Fukazawa ..... H01R 12/716 439/660
2009/0239422 A1 * 9/2009 Fukazawa ..... H01R 12/716 439/660
2010/0029134 A1 * 2/2010 Matsuzaki ..... H01R 12/716 439/607.57
2011/0294326 A1 * 12/2011 Tanaka ..... H01R 12/712 439/248
2014/0134883 A1 * 5/2014 Kobayashi ..... H01R 12/712 439/626
2015/0024620 A1 * 1/2015 Kobayashi ..... H01R 12/716 439/345
2015/0064935 A1 * 3/2015 Funayama ..... H01R 12/91 439/1
2015/0132976 A1 * 5/2015 Sato ..... H01R 4/028 439/74
2015/0132998 A1 * 5/2015 Sato ..... H01R 12/91 439/676
2015/0132999 A1 * 5/2015 Sato ..... H01R 24/60 439/676
2015/0244093 A1 * 8/2015 Funayama ..... H01R 12/91 439/65
2015/0270658 A1 * 9/2015 Aoki ..... H01R 4/48 439/660
2016/0294111 A1 * 10/2016 Kobayashi ..... H01R 13/187
2017/0033480 A1 * 2/2017 Sato ..... H01R 12/716
2017/0170588 A1 * 6/2017 Doi ..... H01R 12/7005
2017/0338592 A1 * 11/2017 Doi ..... H01R 13/6315

* cited by examiner

ELECTRICAL CONNECTOR FOR CIRCUIT BOARDS AND MANUFACTURING METHOD THEREOF

CROSS REFERENCE TO RELATED APPLICATIONS

This Paris Convention Patent Application claims benefit under 35 U.S.C. § 119 and claims priority to Japanese Patent Application No. JP 2016-220723, filed on Nov. 11, 2016, titled "ELECTRICAL CONNECTOR FOR CIRCUIT BOARDS AND MANUFACTURING METHOD THEREOF", the content of which is incorporated herein in its entirety by reference for all purposes.

BACKGROUND

Technical Field

The present invention relates to an electrical connector for circuit boards and a manufacturing method thereof.

Background Art

Known electrical connectors or circuit boards include so-called floating connectors, which permit a connectable counterpart component, such as a counterpart connector connected to said electrical connector, to move relative to said electrical connector.

Such a floating connector has a stationary housing, which secures in place one end of the terminals and maintains a fixed position with respect to a circuit board due to the fact that said terminals are solder-connected to said circuit board, and a movable housing which, being separate from said stationary housing and movable relative to said stationary housing, secures in place the other end of the above-mentioned terminals that is in contact with, and connected to, the above-mentioned connectable counterpart components. The terminals have a resilient portion that is not supported in any way and is located between the portions secured in place by the above-mentioned stationary housing and movable housing. As a result of resilient deformation of said resilient portions, the above-mentioned movable housing is rendered movable relative to the stationary housing and makes so-called floating possible.

Known floating connectors include, for example, the connector disclosed in Patent Document 1. In Patent Document 1, the terminals have one end thereof secured in place by unitary molding in the stationary housing (pedestal), and the other end secured in place by unitary molding in the movable housing (terminal case) located above said stationary housing. One end of the above-mentioned terminals has a connecting portion whose distal end extends out of the stationary housing and is solder-connected to the circuit board, and the other end has a contact portion, which is positioned on the inner face of a receiving portion receiving a connectable counterpart component and which is electrically connected to said connectable counterpart component.

The above-mentioned terminals have a rectilinear portion that projects outside the movable housing from the above-mentioned contact portion and extends downwardly. A section that is bent in an L-shaped configuration at the lower end of said rectilinear portion is secured in place by the stationary housing, and a resilient portion is formed in the above-mentioned rectilinear portion between the above-mentioned movable housing and stationary housing. As described above, said resilient portion extends in a rectilinear manner and couples the movable housing to the stationary housing at the shortest distance possible.

PRIOR ART DOCUMENTS

Patent Documents

Patent Document 1

Japanese Patent No. 3976454

SUMMARY

Problems to be Solved by the Invention

The advantages of the connector of Patent Document 1 include an increase in terminal retention strength due to the fact that the terminals are secured in place by unitary molding both with the stationary housing at one end and with the movable housing at the other end, respectively, as well as a reduction in the manufacturing cost due to the fact that terminal retention can be ensured in a single manufacturing step.

However, the resilient portion of the terminals is fashioned as a rectilinear portion for the convenience of simplifying the unitary molding of the terminals with both housings (i.e., the stationary housing and movable housing) and, as a result, the amount of its resilient deformation is reduced because the stationary housing and movable housing are connected at the shortest distance possible. In other words, the amount of floating is reduced. However, if the above-mentioned resilient portion is made longer in at attempt to increase the amount of resilient deformation, the dimensions of the connector in the height-wise direction are accordingly increased. This is not appropriate for these types of connectors, which seek to maintain a low profile while minimizing the height above the circuit board.

Considering the above-described circumstances, it is an object of the present invention to provide an electrical connector for circuit boards and a manufacturing method thereof, wherein the amount of resilient deformation in the resilient portion of the terminals can be increased while ensuring a low profile in which the dimensions of the connector in the height-wise direction are reduced while the terminals are rigidly secured in place by unitary molding both in the stationary housing and in the movable housing.

Means for Solving the Problems

It is an object of the invention to provide a floating-enabled connector that has enhanced terminal retention and a low profile, and is compact in the connector-width direction.

According to the present invention, the above-described problem is solved by an electrical connector for circuit boards according to the first example implementation below and by a manufacturing method of an electrical connector for circuit boards according to the second example implementation below.

FIRST EXAMPLE IMPLEMENTATION

Electrical Connector for Circuit Boards

In the electrical connector for circuit boards according to the first example implementation, each one of a plurality of terminals arranged in an array has, at one end, a connecting portion for connecting to a mounting surface of a circuit board and, at the other end, a contact portion for contacting a counterpart contact member mated therewith; a housing securing said terminals in place has a stationary housing, which is fixedly mounted to the circuit board, and a movable housing, which constitutes a separate member from said stationary housing and is movable relative to said stationary housing; and the above-mentioned counterpart contact member is mated with the movable housing.

In such an electrical connector for circuit boards, in the first example implementation, the above-mentioned terminals are characterized by the fact that the terminals have a movable-side retained portion including a contact portion secured in place by unitary molding with the movable housing in a movable-side retaining portion of said movable housing, a stationary-side retained portion secured in place by unitary molding with the stationary housing at a location proximate the connecting portion of the terminals in a stationary-side retaining portion of said stationary housing, and a resiliently displaceable resilient portion coupling the movable-side retained portion to said stationary-side retained portion; the resilient portion of the above-mentioned terminals has a curved apex portion constituting the upper end of said resilient portion outwardly of the movable-side retained portion in the connector-width direction perpendicular to the terminal array direction within a plane parallel to the mounting surface of the above-mentioned circuit board; and lateral open spaces that are open in the connector-width direction are formed in a range including at least the apex portion below the above-mentioned movable-side retaining portion positioned above the above-mentioned apex portion at the locations of the terminals in the terminal array direction.

In the first example implementation, the movable-side retained portion of the terminals is secured in place by unitary molding in the movable housing and the stationary-side retained portion of said terminals is similarly secured in the stationary housing, thereby providing for significant terminal retention strength in both housings (i.e., said movable housing and said stationary housing). In addition, since the resilient portion of the above-mentioned terminals is curved so as to have an apex portion, a significant resiliently displaceable spring length can be ensured and sufficient floating is made possible without making said resilient portion larger in the vertical direction. Furthermore, in the electrical connector for circuit boards according to the first example implementation, spaces that are open in the connector-width direction are formed in a range that includes at least the apex portion in the vertical direction at the locations of the terminals in the terminal array direction. As a result, despite the curved shape that the resilient portion of the terminals has in the apex portion, it becomes possible to move a mold in the connector-width direction towards the molding position and install it there.

In the first example implementation, the terminals are disposed in two rows facing each other symmetrically in the connector-width direction, and the stationary housing may be made up of separate members separated in the above-mentioned terminal array direction in order to respectively fixedly secure in place each of the above-mentioned two terminal rows. The two stationary housings represented by separate members in this manner may be coupled using connecting fittings extending in the connector-width direction. Using connecting fittings to couple the stationary housings in this manner can increase the reinforcement of the stationary housings themselves as well as the mounting strength of the stationary housings at the time of mounting to the circuit board.

In the resilient portion of the first example implementation, preferably at least part of said resilient portion in the connector-width direction is located within the width-wise range of the movable housing. Positioning the resilient portion in this manner allows for the connector to be made more compact in the connector-width direction.

SECOND EXAMPLE IMPLEMENTATION

Manufacturing Method of an Electrical Connector for Circuit Boards

The manufacturing method of an electrical connector for circuit boards according to the second example implementation is a method of manufacturing the electrical connector for circuit boards according to the first example implementation.

This manufacturing method, in the second example implementation, is characterized by the fact that an upper mold installed from above, side molds installed laterally in the connector-width direction, and a lower mold installed from below are used for the unitary molding of the movable housing with the movable-side retained portions of the terminals in the upper and side molds, and, in addition, for the unitary molding of the stationary housings with the stationary-side retained portions of the terminals in the lower and side molds.

According to this second example implementation, the three kinds of molds (i.e., the upper, side, and lower molds) can be used to unitarily mold the movable housing with the movable-side retained portions of the terminals while at the same time, in a single step, unitarily molding the stationary housings with the stationary-side retained portions of the terminals. For this reason, the manufacturing process of the connector can be simplified and, in addition, the manufacturing cost can be reduced.

In the second example implementation, the side molds may be laterally moved to, and installed in, the molding position so as to hold the resilient portions of the terminals in clearance grooves formed in said side molds. Using the side molds with clearance grooves formed therein in this manner makes it possible to avoid interference between the resilient portions and the side molds during unitary molding and, in addition, makes it possible to set the position of said resilient portions by holding the resilient portions within the clearance grooves.

In the second example implementation, a plurality of terminals may be coupled by a carrier at the locations of the distal ends of the connecting portions of said terminals prior to unitary molding in the molds and may be detached from the carrier at the above-mentioned locations of the distal ends after unitary molding.

Effects of the Invention

As described above with regard to the connector, in the present invention, firstly, significant terminal retention strength is achieved because the terminals are secured in place by unitary molding with the stationary housings and movable housing; secondly, the use of a configuration in which the resilient portions of the terminals have curved apex portions meets the need for low profile connectors and, at the same time, makes it possible to increase the amount of resilient deformation in the resilient portions, in other words, the amount of floating; and thirdly, forming lateral open spaces that are open in the connector-width direction in a range including the apex portions of said resilient portions makes the connector more compact in the width direction thereof and, at the same time, allows for molds to be installed and removed in the connector-width direction and permits unitary molding even though the terminals have the above-mentioned curved resilient portions. In addition, as concerns the manufacturing method of this connector, the manufacture of the above-described connector is made possible by the use of a mold made up of an upper mold, side molds, and a lower mold.

BRIEF DESCRIPTION OF DRAWINGS

FIG. 2(A) is before connector mating, and FIG. 2(B) is after connector mating.

DETAILED DESCRIPTION

Embodiments of the present invention are described below with reference to the accompanying drawings.

Figure 1:
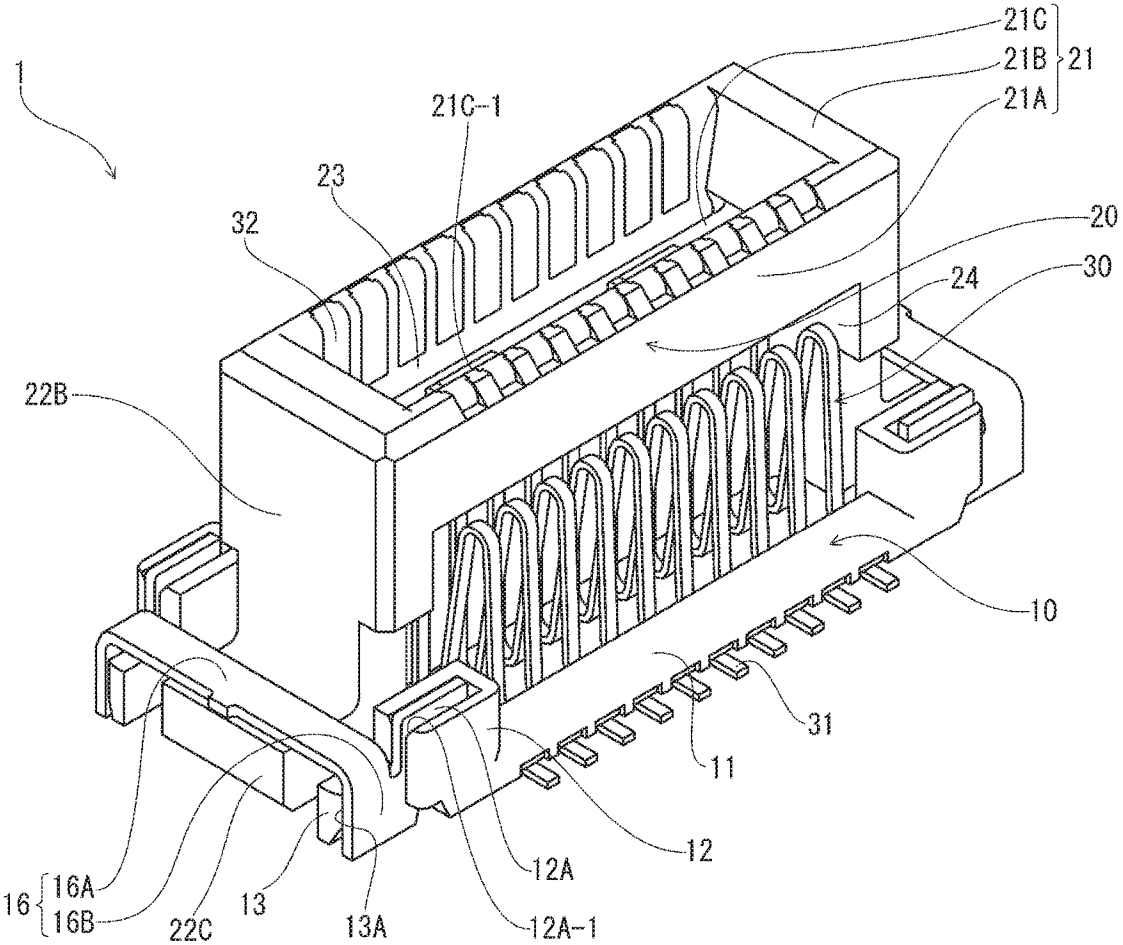
FIG. 1 illustrates a perspective view illustrating the appearance of an electrical connector for circuit boards used in an embodiment of the present invention, with the direction of mating with counterpart connectors oriented upward.
Figure 2B:
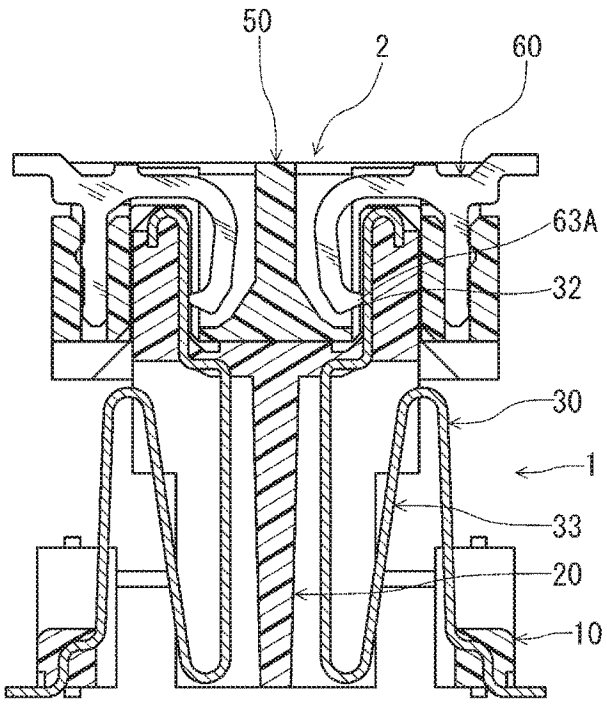
FIGS. 2(A) and 2(B) illustrate cross-sectional views taken at the location of the terminals that illustrate the connector of FIG. 1 along with a counterpart connector, where
Figure 2A:
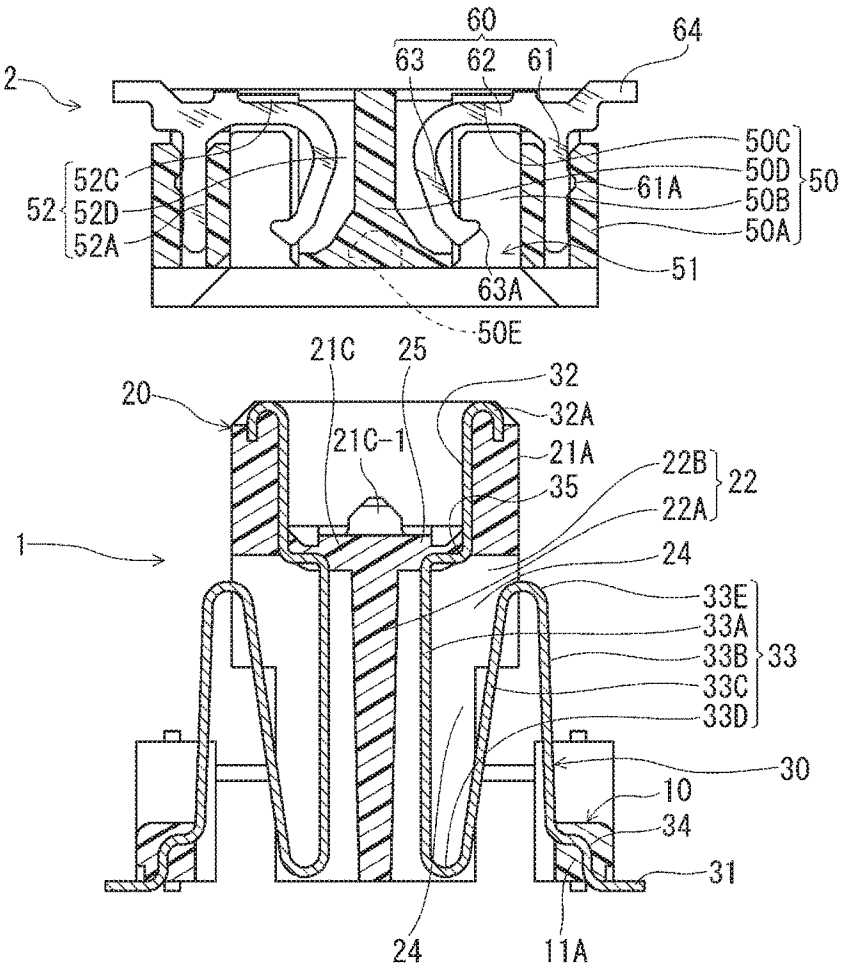
Figure 3:
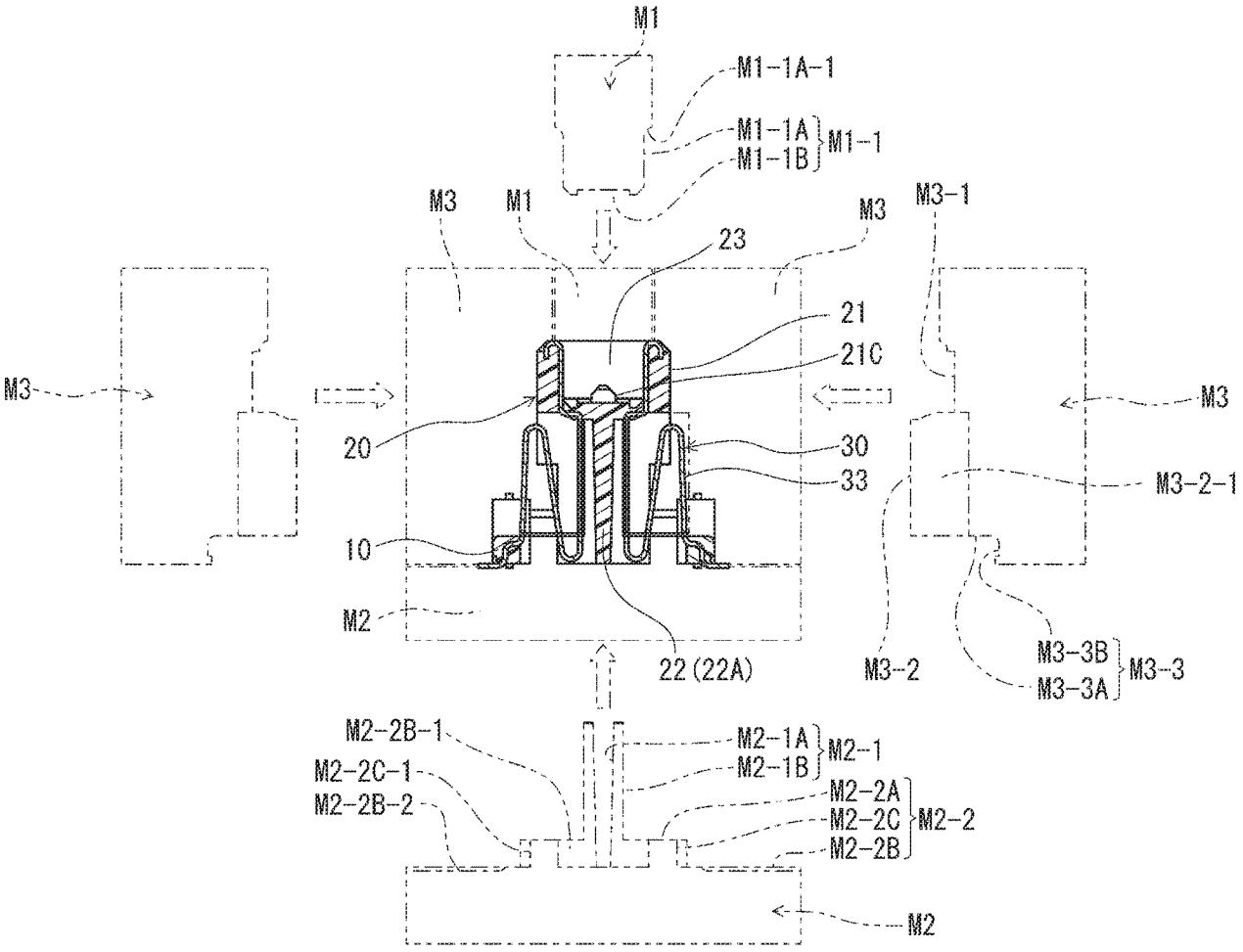
FIG. 3 illustrates the position of said connector and molds to describe the unitary molding-based manufacturing procedure used for the connector of FIG. 1.

FIG. 1 is a perspective view illustrating the appearance of an electrical connector for circuit boards used the present embodiment (hereinafter referred to as the "connector"), FIG. 2 shows cross-sectional views taken at the location of the terminals that illustrate the connector of FIG. 1 along with a counterpart connector, where (A) is before connector mating, and (B) is after connector mating, and FIG. 3 is an explanatory figure illustrating the manufacturing procedure used for the connector of FIG. 1 along with the fitting used for unitary molding.

As can be seen from FIG. 1 and FIG. 2(A), the connector 1 of the present embodiment has stationary housings 10, a movable housing 20, and terminals 30. As a whole, the connector 1 has an oblong rectangular parallelepiped-like external configuration, its bottom face is placed on a circuit board (not shown), and the terminals 30 are solder-connected to corresponding circuitry on said circuit board. In this embodiment, the connector 1 is made symmetrical in either direction, that is, in the lengthwise direction, which is a direction parallel to the surface of the circuit board, and in the connector-width direction, which is a transverse direction perpendicular thereto. The stationary housings 10, which are made of an electrically insulating material, are disposed on surface of the circuit board on both sides of the lower end portion of the movable housing 20 in the connector-width direction, in positions spaced away from said movable housing 20, as members separate from said movable housing 20 and shaped as square bars extending in the above-mentioned longitudinal direction. The above-mentioned stationary housings 10 on both sides are formed as separate members.

As can be seen in FIG. 1, each of the above-mentioned stationary housings 10, which are positioned on both sides of the above-mentioned movable housing 20 facing the lower end portions of said movable housing 20 in the height-wise direction and which are positioned on both sides of the movable housing 20 so as to be separated from each other, has a middle portion 11, which extends in the longitudinal direction of the above-mentioned connector, coupled portions 12, which are formed at the two ends of said middle portion 11 in the longitudinal direction so as to be higher than said middle portion 11, and supporting end portions 13, which extend outward in the above-mentioned longitudinal direction from said coupled portions 12. The above-mentioned middle portion 11 is shaped as a relatively thin square bar with a square cross-section. Said middle portion 11 has a stationary-side retaining portion 11A that secures in place one end (lower end in the drawing) of the hereinafter-described terminals 30 by unitary molding (see FIG. 2(A)). The coupled portions 12 at both ends of the above-mentioned stationary housings 10 have formed therein mating groove portions 12A that open through the upper faces and end faces in the above-mentioned longitudinal direction. In said mating groove portions 12A, the upper edge of the groove entrance has a tapered portion 12A-1, which makes it easier for the mating pieces 16B of the hereinafter-described coupling members 16 to be fitted therein from above. In addition, there are supporting end portions 13, which are formed in a stepped manner such that, relative to the above-mentioned coupled portions 12, they are positioned inward of the above-mentioned mating groove portions 12A in the connector-width direction and are lower and thinner than the above-mentioned coupled portions 12, and which protrude in the above-mentioned longitudinal direction from the above-mentioned coupled portions 12. Said supporting end portions 13 form support faces 13A, whose exterior lateral faces support the coupling members 16 in the connector-width direction.

The above-mentioned coupling members 16 are shaped like curved metal strips and have a middle portion 16A, which extends in the connector-width direction parallel to the surface of the circuit board, and leg-like mating pieces 16B, which are bent downward at both ends of said middle portion 16A perpendicularly to the flat major surface thereof. As a whole, the coupling members 16 have an inverted U-shaped configuration. In said coupling members 16, the leg-like mating pieces 16B provided at both ends thereof are mated from above with the mating groove portions 12A formed in the coupled portions 12 of the above-mentioned stationary housings 10. There are two coupling members 16 provided for mating with the respective coupled portions 12 at both ends of the above-mentioned two stationary housings 10 in the lengthwise direction of the connector. In this manner, each of the two coupling members 16 is used to couple the two stationary housings 10 at both ends thereof, producing a square frame-like configuration enclosing the bottom portion of the movable housing 20 in conjunction with said coupling members 16. Thus, the two stationary housings 10 coupled by the coupling members 16 are rigidly secured to the circuit board at positions on both sides of the movable housing 20.

In addition to increasing the strength of attachment of the above-described two stationary housings 10 to the circuit board, the advantages of using these coupling members 16 include size reduction in the lengthwise direction of the connector and simplifying the manufacture of the stationary housings 10. As far as connector size reduction is concerned, an attempt to couple the above-mentioned two stationary housings using other members or sections constituting part of the stationary housings longitudinally out of both ends of the two illustrated stationary housings 10 would increase the size of the connector by the size of the above-mentioned longitudinally outboard members or sections. For this reason, a more compact connector is obtained when the illustrated coupling members 16 are used. Furthermore, as far as simplifying the manufacture of the connector is concerned, in the present invention, the mold used for molding is simplified by using stationary housings of a relatively simple shape extending only in the lengthwise direction of the connector. Should the above-described coupling sections be molded integrally with the stationary housings, the mold will become correspondingly more complicated. Alternatively, using separate members will require another mold. For this reason, the manufacture of the connector can be simplified when the illustrated coupling members 16 are used.

In the same manner as the stationary housings 10, the movable housing 20 is made of an electrically insulating material and has a mating portion 21, which forms a top half, and a support 22, which forms a bottom half.

In the above-mentioned mating portion 21, which has an upwardly open closed-bottomed polygonal tubular configuration, a bottom wall 21C and a perimeter wall made up of lateral walls 21A and end walls 21B form a receiving portion 23, which is a concave space that receives a counterpart connector described below. Terminals 30, which are described below, are secured in place by the bottom wall 21C and the inner lateral faces of the lateral walls 21A extending in the longitudinal direction of said receiving portion 23. An electrical connection is established when the counterpart connector is received in the above-mentioned receiving portion 23 and counterpart terminals provided in said counterpart connector come in contact with the above-mentioned terminals 30. Guide protrusions 21C-1 used to absorb impact during mating with the counterpart connector are formed in an upwardly-protruding manner on the bottom wall 21C of the mating portion 21, in which said receiving portion 23 is formed, in multiple locations in the above-mentioned longitudinal direction at a mid-width position of the connector. Mating these guide protrusions 21C-1 with the corresponding portions of the counterpart connector prevents collision with the inner face of the perimeter wall of the connector 1, in particular, the inner face of the lateral walls 21A, in the connector-width direction during mating with the counterpart connector.

As can be seen in FIG. 2(A), the support 22 of the above-mentioned movable housing 20 has a vertical central wall portion 22A, which extends downwardly from the bottom wall 21C of the above-mentioned mating portion 21 at a mid-width location of the connector and passes in the lengthwise direction of the connector throughout the entire length of the above-mentioned receiving portion 23 in the above-mentioned longitudinal direction, and vertical end wall portions 22B, which are provided integrally with said vertical central wall portion 22A at both ends of said vertical central wall portion 22A in the above-mentioned longitudinal direction and extend in the connector-width direction. Lateral open spaces 24, which extend laterally in the range from the above-mentioned vertical central wall portion 22A all the way to the above-mentioned stationary housings 10 positioned outwardly of the above-mentioned receiving portion 23 in the connector-width direction, are formed in this movable housing 20 by the vertical central wall portion 22A and the vertical end wall portions 22B of the above-mentioned support 22 under the bottom wall 21C.

As can be seen in FIG. 1, restricted portions 22C, which extend outwardly in the lengthwise direction of the connector from the vertical end wall portions 22B, are provided at the lower ends of said vertical end wall portions 22B of the above-mentioned support 22 and are positioned under the middle portions 16A of the coupling members 16 that couple the two stationary housings 10. The upper faces of said restricted portions 22C closely face the lower faces of the above-mentioned middle portions 16A, and when the movable housing 20 moves upwardly in excess of a permissible limit, the movement is restricted as said restricted portions 22C abut the above-mentioned middle portions 16A.

Although the above-mentioned support 22 extends downwardly from the bottom wall 21C of the mating portion 21, where the receiving portion 23 is formed, to the vicinity of the surface of the circuit board, it is not secured to said circuit board, and the entire movable housing 20 is movable in the width direction, lengthwise direction, and vertical direction of the connector when acted upon by external forces.

As can be seen in FIG. 1 and FIG. 2(A), throughout their entire length, the terminals 30 have a strip-like configuration and, with the exception of the contact portions 32, are made by bending narrow metal flat strip-like pieces of equal width in the through-thickness direction thereof. The contact portions 32 are slightly larger in width than the other portions. Accordingly, the dimensions in a direction perpendicular to the through-thickness direction are the width of the terminals. As can be seen from FIG. 2(A), when the connector 1 is viewed in the longitudinal direction, the terminals 30 have laterally S-shaped resilient portions 33 between connecting portions 31 formed at one end portion located at the bottom, and contact portions 32 formed at the other end portion located at the top. Said terminals 30 are provided in pairs symmetrical in the connector-width direction, with multiple pairs arranged in the lengthwise direction of the connector.

The above-mentioned connecting portions 31 are positioned on the upper face of the circuit board and extend laterally parallel to the surface of said circuit board. In the sections adjacent to said connecting portions 31, the terminals 30 have stationary-side retained portions 34 curved in a crank-like configuration, with said stationary-side retained portions 34 secured in place by unitary molding with the above-mentioned stationary housings 10. In other words, the stationary housings 10 have formed therein stationary-side retaining portions for the stationary-side retained portions 34 of the terminals. The above-mentioned connecting portions 31 protrude on the bottom faces of the stationary housings 10 and extend laterally along said bottom faces.

On the other hand, the contact portions 32 pass through the bottom wall 21C of the movable housing 20 and extend in a rectilinear manner in parallel to the inner lateral faces of the lateral walls 21A of said movable housing 20 in the section above said bottom wall 21C, with their upper end sections forming inverted U-shaped upper end curved portions 32A bent outwardly in the connector-width direction. The distal end portions of the upper end curved portions 32A are completely embedded in the lateral walls 21A of the movable housing 20, and the other portions of said upper end curved portions 32A have only the upper faces thereof exposed while the lower faces and the lateral end faces thereof are embedded in the above-mentioned lateral walls 21A. The upper faces of the above-mentioned upper end curved portions 32A, in particular, the inner-side upper faces on the inner sides in the connector-width direction, protrude slightly relative to the upper faces of the lateral walls 21A of the above-mentioned movable housing 20 and form faces at substantially the same level as said lateral walls 21A to serve as guiding lead-in surfaces for the counterpart connector.

The contact portions 32, which extend in a rectilinear manner downwardly from the above-mentioned upper end curved portions 32A, in parallel to the inner lateral faces of the lateral walls 21A constituting part of the perimeter wall of the mating portion 21 where the receiving portion 23 of the movable housing 20 is formed, form contact surfaces whose inner surfaces facing the receiving portion 23 side are exposed by slightly protruding from the inner lateral faces of the above-mentioned lateral walls 21A and which are in contact with the terminals of a counterpart connector. In said contact portions 32, the surfaces that are located on the side opposite to said contact surfaces, as well as their lateral end faces, are embedded in the above-mentioned lateral walls 21A.

The above-mentioned terminals 30 have formed therein movable-side retained portions 35, whose sections located directly under the above-mentioned contact portions 32 are bent in an L-shaped configuration. The above-mentioned movable side retained portions 35 are secured in place by unitary molding with the movable housing 20 in movable-side retaining portions 25 formed in the sections extending from the lateral walls 21A of the above-mentioned movable housing 20 towards the bottom wall 21C. The underside of said movable-side retained portions 35 is exposed in order to allow for said underside to be supported by the mold during unitary molding.

In the above-mentioned terminals 30, the sections located below the movable-side retained portions 35 extend downwardly through the bottom wall 21C of the movable housing 20 all the way to the resilient portions 33 that couple said bottom wall 21C and the stationary housings 10.

The above-mentioned resilient portions 33, which have a sideways S-like configuration, have an inner rectilinear portion 33A positioned inwardly in the connector-width direction, an outwardly positioned outer rectilinear portion 33B, an intermediate rectilinear portion 33C positioned therebetween, and, furthermore, a lower end curved portion 33D that couples the inner rectilinear portion 33A and intermediate rectilinear portion 33C at their lower ends, and an upper end curved portion 33E that couples the intermediate rectilinear portion 33C and outer rectilinear portion 33B at their upper ends. Said upper end curved portion 33E constitutes an apex portion of the resilient portions 33. As will be noted in FIG. 2(A), in the above-mentioned resilient portions 33, the sections located inwardly of the above-mentioned upper end curved portions 33E in the connector-width direction are positioned inwardly of the lateral walls 21A of the movable housing 20 in the same direction, in other words, substantially contained within the above-mentioned lateral open spaces 24 of the movable housing 20. The inner rectilinear portions 33A of said resilient portions 33 extend along the vertical central wall portion 22A, which forms part of the support 22 of the movable housing 20, but are spaced apart from said vertical central wall portion 22A. In this manner, resilient displacement (resilient deformation) of the resilient portions 33 in the above-mentioned lateral open spaces 24 is possible when the terminals 30 are acted upon by external forces. Therefore, the movable housing 20 is mated with a counterpart connector in the receiving portion 23 and if the movable housing 20 is positioned with an offset relative to the stationary housings 10, for example, relative to the normal position in the connector-width direction, the above-mentioned offset is absorbed by the resilient displacement of the above-mentioned resilient portions 33 and the so-called floating takes place. If the offset of the above-mentioned movable housing 20 is, for example, in the rightward direction in FIG. 2(A), resilient displacement occurs such that the resilient portions 33 of the terminals 30 on the right side are compressed in the horizontal direction and the resilient portions 33 of the terminals 30 on the left side are expanded in the same direction.

Next, the manufacturing method of the connector 1 configured as described above will now be described with reference to FIG. 3. In FIG. 3, the cross-section of the connector 1 is shown with a solid line, and the mold M used to mold the housing is shown with a two-dot chain line. Both a molding position and a standby position, in which the mold is located prior to being placed in the molding position are shown for the mold M, and travel from the standby position to the molding position is shown with an arrow drawn using a two-dot chain line.

First, the terminals 30 are made. As far as said terminals 30 are concerned, a metal plate is used to make a primary workpiece in which multiple metal strip-like pieces are coupled at the ends with the help of a carrier (not shown), and said metal strip-like pieces are bent to prepare a secondary workpiece in which multiple terminals 30 are secured in place by the above-mentioned carrier. The multiple terminals 30 secured in place by the carrier are placed inside the mold M for integral molding with the housings.

The mold M is made up an upper mold M1, a lower mold M2, and two side molds M3. Since the connector 1 has a bilaterally symmetrical configuration, as previously discussed, the two side molds M3 have mutually symmetrical configurations. In addition, the upper mold M1 and the lower mold M2, respectively, have bilaterally symmetrical configurations.

The upper mold M1 has a mating portion molding surface M1-1 used to form the inner lateral wall faces of the above-mentioned mating portion 21 constituting the receiving portion 23 formed as a concave space in the above-mentioned mating portion 21 of the movable housing 20 of the connector 1. Said mating portion molding surface M1-1 has a lateral surface M1-1A, which is used to mold the inner lateral faces of the lateral walls 21A of the mating portion 21, and a bottom surface M1-1B, which is used to mold the inner face of the bottom wall 21C of the mating portion 21. The above-mentioned lateral surface M1-1A is fashioned to a shape that is used to mold the lateral walls 21A such that the contact portions 32 of the terminals 30 are secured in place by the above-mentioned lateral walls 21A, the exposed surfaces of said contact portions 32 slightly protrude from the surface of the lateral walls 21A, and the contact portions 32 are embedded and secured in place in the lateral walls 21A. The above-mentioned lateral surface M1-1A has an R-shaped surface M1-1A-1 such that the shape of the upper ends of the lateral walls 21A is rounded.

The lower mold M2 has a vertical surface M2-1, which extends upwardly and is used for molding the support 22 of the above-mentioned movable housing 20, and a horizontal surface M2-2 intended for molding the inner lateral faces and lower faces of the stationary housings 10. The support 22 of the movable housing 20 has a vertical central wall portion 22A, vertical end wall portions 22B, and restricted portions 22C, and although the above-mentioned vertical surface M2-1 is fashioned to a shape suitable for molding the support 22 including the above-mentioned elements, for clarity of understanding, in FIG. 3, the above-mentioned vertical surface M2-1 has illustrated therein only the section corresponding to the vertical central wall portion 22A. The above-mentioned vertical surface M2-1 illustrated in FIG. 3 constitutes a surface used for the molding of the vertical central wall portion 22A with the help of the vertical inner surfaces M2-1A located between two thin vertical posts. In addition, the vertical outer surfaces M2-1B of the two vertical posts constitute surfaces supporting the inner rectilinear portions 33A of the terminals 30 from the inside.

The horizontal surface M2-2 of the lower mold M2 has: a horizontal upper surface M2-2A, which is positioned centrally in the width direction of the connector at the same height as the upper face of the stationary housings 10; a horizontal lower surface M2-2B, which is recessed with respect to said horizontal upper surface M2-2A and positioned on both sides of said horizontal upper surface M2-2A; and lateral surfaces M2-2C, which are positioned inward of both stationary housings 10 in a vertical direction from the horizontal upper surface M2-2A to the horizontal tower surface M2-2B. Said lateral surfaces M2-2C are used to mold the inner lateral faces of the stationary housings 10 and the horizontal lower surfaces M2-2B are used to mold the lower faces of the stationary housings 10. Clearance grooves M2-2C-1, which hold the sections where the stationary-side retained portions 34 of the terminals 30 protrude from the interior top portions of the stationary housings 10, are formed in the above-mentioned lateral surfaces M2-2C so as to open in a lateral direction.

Terminal clearance grooves M2-2B-1, which are used to receive the lower end curved portions 33D of the resilient portions 33 of the above-mentioned terminals 30 and their vicinity, are formed so as to be upwardly open in the horizontal upper surface M2-2A within a range located above the horizontal lower surface M2-2B in sections proximate the above-mentioned vertical central wall portion 22A in the connector-width direction.

The horizontal lower surface M2-2B is provided in a location where the lower face of the stationary housings 10 is molded, and clearance grooves M2-2B-2, which receive the connecting portions 31 protruding from the stationary housings 10 and extending in a lateral direction, are formed in said horizontal lower surface M2-2B.

The side molds M3, which are provided in a bilaterally symmetrical manner, have: upper lateral surfaces M3-1, which are used to form the outer lateral wall faces of the mating portion 21 of the movable housing 20; lower lateral surfaces M3-2, which are positioned below, protruding inwardly in the connector-width direction, and which sandwich the inner rectilinear portions 33A of the terminals 30 in conjunction with the vertical surface M2-1 of the above-mentioned lower mold M2; and stepped portion surfaces M3-3, which are recessed in a stepped manner below said lower lateral surfaces M3-2 outwardly in the connector-width direction relative to said lower lateral surface M3-2. Upper surfaces M3-3A, which extend in the horizontal direction of said stepped portion surfaces M3-3, are used to mold the upper faces of the stationary housings 10, and lateral surfaces M3-3B, which extend in the vertical direction of said stepped portion surfaces M3-3, are used to mold the outer lateral faces of the stationary housings 10. Clearance grooves M3-2-1, which hold the resilient portions 33 of the terminals 30, are formed in the above-mentioned lower lateral surfaces M3-2.

Prior to being placing in the molding position, the components of the above-mentioned mold M are in standby positions, with the upper mold M1 being spaced away upwardly, the lower mold M2 downwardly, and the side molds M3 laterally with respect to said molding position.

The upper mold M1, lower mold M2, and side molds M3 travel from the respective standby positions in the directions indicated by arrows drawn with a two-dot chain line in FIG. 3 and are installed in the molding position as the molds are coupled along surfaces other than the connector molding surfaces. In the molding position, the upper mold M1 is coupled with the side molds M3 along their respective coupling surfaces. At the same time, the side molds M3 are coupled with the lower mold M2 along their respective coupling surfaces. As a result, a mold space is formed for the movable housing 20 and stationary housings 10 while securing in place the terminals 30. At such time, the lower mold M2 receives the lower end curved portions 33D of the terminals in the clearance grooves M2-2B-1 and, in addition, receives the connecting portions 31 of the terminals 30 in the clearance grooves M2-2B-2, while the side molds M3 receive the resilient portions 33 of the terminals 30 in the clearance grooves M3-2-1.

Thus, with the mold M installed in the molding position, molten resin is injected into the above-mentioned mold space and, after curing, the upper mold M1, lower mold M2, and side molds M3 return to the standby positions, thereby producing a connector 1 that has mutually separated stationary housings 10, movable housing 20, and terminals 30 secured in place by unitary molding with the stationary housings 10 and movable housing 20.

As can be seen in FIG. 2(A), the counterpart connector 2 serving as the counterpart contact member mated to the thus configured connector 1 has a counterpart housing 50 made of an electrically insulating material and counterpart terminals 60 made of a metal plate, which are secured in place by said counterpart housing 50. The counterpart contact member does not have to be a counterpart connector such as the one mentioned above, and may be a different member, for example, such as a circuit board or the like.

The counterpart housing 50 has a generally rectangular parallelepiped-like external configuration, wherein a perimeter wall, which is made up of lateral walls 50A and end walls 50B, a bottom wall 50C, and, furthermore, a central wall 50D form mating concave portions 51 that permit insertion of the movable housing 20 of the above-mentioned connector 1. In FIG. 2(A), the counterpart connector 2 is shown disposed in a location above the above-mentioned connector 1 immediately prior to mating with said connector 1, with the bottom wall 50C located at the top while the above-mentioned mating concave portions 51 are open in a downward direction.

The central wall 50D of the counterpart housing 50 extends in the lengthwise direction of the connector (in a direction perpendicular to the plane of the drawing in FIG. 2(A)) at a central location in the connector-width direction. The space inside the perimeter wall formed by the lateral walls 50A and end walls 50B is divided in two in the above-mentioned connector-width direction, with the individual spaces produced by division forming the above-mentioned mating concave portions 51. Guide protrusion-receiving concave portions 50E, which receive the guide protrusions 21C-1 provided in the movable housing 20 of the above-mentioned connector 1, are formed in the above-mentioned central wall 50D in the direction of the open side of the connector (bottom side in FIG. 2(A)).

Terminal grooves 52, which secure in place and receive the hereinafter-described planar counterpart terminals 60, are formed in the above-mentioned counterpart housing 50. In FIG. 2(A), said terminal grooves 52 have an inverted U-shaped configuration and include insertion grooves 52A formed in the lateral walls 50A, holding grooves 52D formed in the central wall 50D, and bottom portion grooves 52C formed in the bottom wall 50C so as to place the insertion grooves 52A and the holding grooves 52D in communication. As discussed below, the counterpart terminals 60 are made by keeping a major surface of a metal plate immobilized and punching in a direction perpendicular to said major surface (i.e., in the through-thickness direction) and, in FIG. 2(A), the above-mentioned major surface is parallel to the plane of the drawing. Therefore, the groove width of the above-mentioned terminal grooves 52 in a direction perpendicular to the plane of the drawing is almost equal to the thickness of the above-mentioned counterpart terminals 60.

The above-mentioned insertion grooves 52A are formed in the shape of slit openings through the above-mentioned lateral walls 50A in the vertical direction, that is, in the connector-mating direction. The holding grooves 52D are formed in the central wall 50D so as to open on the side of the bottom wall 50C and on the side opposite the lateral wall 50A. The bottom portion grooves 52C are formed in the shape of slit openings through the bottom wall 50C in the vertical direction. The above-mentioned insertion grooves 52A, holding grooves 52D, and bottom portion grooves 52C are placed in communication, thereby forming a single terminal groove 52. At least in the holding groove 52D and bottom portion groove 52C, the groove width of this terminal groove 52 in a direction perpendicular to the plane of the drawing is slightly wider than the thickness of the counterpart terminals 60, and the counterpart terminals 60 permit resilient displacement in the holding groove 52D and bottom portion groove 52C.

The counterpart terminals 60, which are fabricated by punching a metal plate while keeping its major surface flat, in a through-thickness direction perpendicular to said major surfaces, have flat surfaces in a plane parallel to the plane of the drawing in FIG. 2(A). In FIG. 2(A), the shape of these counterpart terminals 60 has an inverted U-shaped section and a protrusion protruding outward from the counterpart housing 50 in one direction in the top portion of said inverted U-shaped section. The section having the inverted U-shaped configuration has a rectilinear fixed arm portion 61, which is press-fitted from above into the insertion groove 52A within the above-mentioned terminal groove 52, an extending arm portion 62, which is bent towards the central wall 50D from the upper end of said fixed arm portion 61 and extends along the bottom wall 50C while being located in the above-mentioned bottom portion groove 52C, and a contact arm portion 63, which is bent from said extending arm portion 62 and extends downwardly in FIG. 2(A) in the direction of the open side of the mating concave portion 51 while being located in the above-mentioned holding groove 52D. The protrusion, which is oriented outward from the counterpart housing 50 from a transitional location between the above-mentioned fixed arm portion 61 and extending arm portion 62, forms a connecting portion 64 and is provided so as to protrude in the connector-width direction (laterally in FIG. 2(A)).

The above-mentioned fixed arm portion 61 has an anchoring projection 61A provided at the edge thereof, and when said fixed arm portion 61 is press-fitted into the insertion groove 52A up to a predetermined location, it engages and is secured to the inner wall surface of the insertion groove 52A, thereby preventing its extraction.

At the distal ends of the above-mentioned contact arm portions 63, there is provided a contact portion 63A, which protrudes into the mating concave portion 51. Said contact portion 63A is a portion intended for contacting the contact portions 32 of the terminals 30 of the previously described connector 1. The contact portion 63A of said counterpart terminals 60 is brought into contact with a major surface perpendicular to the through-thickness direction of the above-mentioned strip-shaped terminals 30 in a cross-section taken in the through-thickness direction thereof. In other words, the through-thickness direction of the above-mentioned counterpart terminals 60 and the through-thickness direction of the above-mentioned terminals 30 are at right angles to each other.

The contact arm portions 63 of the above-mentioned counterpart terminals 60 are in the holding groove 52D, the extending arm portions 62 are in the bottom portion groove 52C, and a gap is formed between the inner surfaces of the grooves in the through-thickness direction (direction perpendicular to the plane of the drawing in FIG. 2(A)) of said counterpart terminals 60. Therefore, the above-mentioned contact arm portions 63 and extending arm portions 62 are capable of undergoing resilient deformation in the terminal grooves 52. Accordingly, as a result of the above-mentioned resilient displacement, the contact portions 63A of said counterpart terminals 60 are brought into contact with the contact portions 32 of the terminals 30 of the connector 1 under contact pressure.

The connector 1 of the previously described present embodiment, along with the above-described counterpart connector 2, is used in the following manner.

First, the connector 1 and counterpart connector 2 are mounted to the respective corresponding circuit boards (not shown). The connector 1 has the connecting portions 31 of its terminals 30 solder-connected to the circuitry of the corresponding circuit board, and the counterpart connector 2 has the connecting portions 64 of its counterpart terminals 60 solder-connected to the circuitry of the other corresponding circuit board.

In this state, the counterpart connector 2 is brought to a location above the connector 1 in a state immediately prior to mating, in which its mating concave portions 51 are open in a downward direction. The counterpart connector 2 is then lowered along with the other circuit board, to which said counterpart connector 2 is mounted. As the counterpart connector 2 is lowered, the mating portion 21 of the above-mentioned connector 1 enters the mating concave portions 51 of said counterpart connector 2 and the connector 1 and counterpart connector 2 are brought into a mutually mated state in the normal position illustrated in FIG. 2(B). At such time, the guide protrusions 21C-1 of the connector 1 enter the guide protrusion-receiving concave portions 50E of the counterpart connector 2, thereby defining the respective positions of the connector 1 and counterpart connector 2.

In such a mated state of the connector 1 and counterpart connector 2, as a result of resilient displacement of the contact arm portions 63, the contact portions 63A of the counterpart terminals 60 of the counterpart connector 2 produce contact pressure and establish an electrical connection with the contact portions 32 of the terminals 30 of the connector 1.

The mating position of the counterpart connector 2 with respect to the connector 1 is not necessarily the normal position. For example, sometimes the above-mentioned counterpart connector 2 is mated with the connector 1 at a position offset from the above-mentioned normal position in the connector-width direction. Such mating at an offset position likely to occur because the above-mentioned counterpart connector 2 is mounted to a circuit board and the view of the connector 1 is obstructed by this circuit board. For example, if the mating of the counterpart connector 2 to the connector 1 starts at a position where the counterpart connector 2 is offset to the right from the normal position in FIG. 2(A), then, in the counterpart connector 2, the counterpart housing 50 of said counterpart connector 2 will push the movable housing 20 of the connector 1 to the right in the process of mating. Consequently, as a result of the resilient displacement (resilient deformation) of the resilient portions 33 of the terminals 30, the movable housing 20 moves rightward relative to the stationary housings 10. In other words, the above-mentioned resilient portions 33 absorb the above-mentioned offset. At such time, the terminals 30 on the right side in FIG. 2(A) compress the resilient portions 33 in the connector-width direction and expand the resilient portions 33 of the terminals 30 on the left side.

In this manner, even if the counterpart connector 2 is mated at position offset from the normal position, as long as the amount of offset is within tolerance limits, the offset can be managed via the resilient displacement of the above-mentioned resilient portions 33. At such time, the resilient displacement of the resilient portions 33 causes internal stress in the terminals 30 depending on the amount of the resilient displacement. This internal stress is transmitted to the stationary-side retained portions 34 at one end of the terminals 20 and to the movable-side retained portions 35 and contact portions 32 at the other end. However, since in this embodiment the terminals 30 are secured in place by unitary molding with the stationary housings 10 and the movable housing 20, the retaining power of the above-mentioned stationary-side retained portions 34, as well as the movable side retained portions 35 and contact portions 32, is strong and sufficient to withstand the above-mentioned stress.

Furthermore, since in this embodiment most of the resilient portions 33 of the terminals 30 are contained within the lateral open spaces 24 formed below the movable housing 20 and, in addition, within the connector-width direction range of the movable housing 20, the connector 1 is configured in a compact manner in the above-mentioned connector-width direction.

DESCRIPTION OF THE REFERENCE NUMERALS

1 Connector
2 Counterpart contact member (counterpart connector)
10 Stationary housing
11A Stationary-side retaining portion
20 Movable housing
24 Lateral open space
25 Movable-side retained portion
30 Terminal
31 Connecting portion
32 Contact portion
33 Resilient portion
33E Apex portion (upper end curved portion)
34 Stationary-side retained portion
35 Movable-side retained portion
M Mold
M1 Upper mold
M2 Lower mold
M3 Side mold

What is claimed is:

1. An electrical connector comprising:

a plurality of terminals arranged in an array, each of the plurality of terminals comprising:

a connecting portion at one end for connecting to a mounting surface of a circuit board, and a contact portion at another end for contacting a counterpart contact member mated therewith;

a stationary housing securing said plurality of terminals in place that is fixedly mounted to the circuit board, and a movable housing that is separate from said stationary housing and is movable relative to said stationary housing; wherein the counterpart contact member is mated with the movable housing, wherein the each of the plurality of terminals comprises:

a movable-side retained portion wherein the contact portion is secured in place by unitary molding with the movable housing in a movable-side retaining portion of said movable housing, a stationary-side retained portion secured in place by the unitary molding with the stationary housing at a location proximate the connecting portion in a stationary-side retaining portion of said stationary housing, and a resiliently displaceable resilient portion coupling the movable-side retained portion to said stationary-side retained portion; the resilient portion comprising a curved apex portion on an upper end of said resilient portion outwardly of the movable-side retained portion in a connector-width direction perpendicular to the terminal array direction within a plane parallel to the mounting surface of the circuit board; and wherein lateral open spaces are formed in the connector-width direction in a range including at least an apex portion below the movable-side retaining portion that is positioned above the curved apex portion in the terminal array direction such that at least a portion of the curved apex portion of each of the resiliently displaceable resilient portion is exposed by the lateral open spaces along a connector-width direction of the stationary housing.

2. The electrical connector for circuit boards of claim 1, wherein the plurality of terminals are disposed in two rows facing each other symmetrically in the connector-width direction, and the stationary housing comprises separate members separated in a terminal array direction, the separate members configured to fixedly secure in place each of the two terminal rows respectively.

3. The electrical connector for circuit boards of claim 2, wherein the stationary housing comprises two stationary housings represented by the separate members that are coupled using connecting fittings extending in the connector-width direction.

4. The electrical connector for circuit boards according to claim 1 wherein, in the resilient portion, at least part of said resilient portion in the connector-width direction is located within the width-wise range of the movable housing.

* * * * *